US005201559A

United States Patent [19]

Boring et al.

[11] Patent Number: 5,201,559

[45] Date of Patent: Apr. 13, 1993

[54] KING PIN RELEASE TOOL

[76] Inventors: Russell W. Boring, 3275 Twisted Oaks La., Jacksonville, Fla. 32223; Walter Guntharp, Jr., 661 Holiday Dr., Fortville, Ind. 46040

[21] Appl. No.: 621,336

[22] Filed: Dec. 3, 1990

[51] Int. Cl.[5] ..... B25F 1/04

[52] U.S. Cl. ..... 294/19.1; 294/26

[58] Field of Search ..... 294/19.1, 24, 26; 7/100; 403/109

[56] References Cited

U.S. PATENT DOCUMENTS

| | | | |
|---|---|---|---|
| 256,611 | 4/1882 | Askew . | |
| 262,346 | 8/1882 | Barrett et al. . | |
| 442,061 | 12/1890 | Lewis . | |
| 583,172 | 5/1897 | Draper . | |
| 1,724,435 | 8/1929 | Studwell . | |
| 2,542,665 | 2/1951 | Gustafson . | |
| 2,590,218 | 3/1952 | Steil | 294/19.1 X |
| 3,644,951 | 2/1972 | Colburn | 294/24 X |
| 3,843,981 | 10/1974 | Verest | 294/24 X |
| 4,050,107 | 9/1977 | Parma | 294/24 X |
| 4,240,658 | 12/1980 | Britson . | |
| 4,513,938 | 4/1985 | Seymour | 403/109 X |
| 4,881,338 | 11/1989 | Lung | 294/26 X |

*Primary Examiner*—Margaret A. Focarino
*Assistant Examiner*—Dean J. Kramer
*Attorney, Agent, or Firm*—Luedeka, Hodges, Neely & Graham

[57] ABSTRACT

A tool for use when releasing the kin pin from a fifth wheel coupling mechanism used for coupling a trailer to a tractor vehicle by pulling upon a handle so that the handle moves in a linear direction from a lock position to a release position includes a pair of telescoping shafts and a hook affixed to one end of one of the shafts. The shafts are telescopically movable between a retracted condition and an extended condition, and the hook is sized to be hooked about the handle of the coupling mechanism. The shafts cooperate with one another so that when the tool is in a retracted condition and the hook is hooked about the coupling mechanism handle and the shaft to which the hook is not affixed is suddenly pulled in a direction which corresponds generally to the direction in which the handle is moved when the handle is moved from its lock position to its release position in order to telescope the tool to its extended position, the momentum of the pulled shaft is transferred to the coupling mechanism handle so that the handle moves from its lock position to its release position.

20 Claims, 3 Drawing Sheets

KING PIN RELEASE TOOL

BACKGROUND OF THE INVENTION

This invention relates generally to the uncoupling of a trailer from a tractor vehicle and relates more particularly to the release of a king pin from a fifth wheel coupling mechanism used to couple a trailer to an over-the-road tractor vehicle.

The class of king pin coupling mechanisms with which this invention is concerned includes a handle which must be moved between two positions of movement in order to release the king pin from the coupling mechanism. Commonly, the handle is moved in a substantially linear direction as it is moved from a lock position at which the king pin is captured by the coupling mechanism and a release position at which the king pin is released from the coupling mechanism. Examples of known coupling mechanisms having such a handle are shown and described in U.S. Pat. Nos. 4,592,566, 2,885,222, 4,871,182 and 4,106,793.

To uncouple a trailer from a tractor vehicle, the handle of the coupling mechanism is grasped by a user and pulled upon in order to release the king pin from the coupling mechanism. By pulling upon the handle with sufficient effort, the handle is moved from its lock position to its release position. If the coupling mechanism includes a safety catch which prevents the handle from being inadvertently moved out of its lock position, the safety catch must be appropriately displaced by the operator to an out-of-the-way position before the handle can be moved to its release position. In either event, the operator must reach into the space provided between the bottom of the trailer frame and the drive wheels of the tractor in order to manipulate the handle and/or the safety catch. Normally, the space between the trailer frame and tractor tires within which the operator must reach is cramped rendering manipulation of the handle and/or safety catch difficult. Moreover, the positioning of an operator's arms between the trailer and tractor exposes the arms to the danger involved in an unintentional separation of the trailer from the tractor vehicle.

Accordingly, it is an object of the present invention to provide a new and improved tool which facilitates the release of a king pin from a fifth wheel coupling mechanism of the aforementioned class.

Another object of the present invention is to provide such a tool which eliminates the need for an operator to reach between the trailer and tractor tires in order to release the king pin from the coupling mechanism.

Still another object of the present invention is to provide such a tool which enhances the safety of an operation involving the uncoupling of a trailer from a tractor vehicle.

A further object of the present invention is to provide such a tool which is uncomplicated in construction and effective in operation.

SUMMARY OF THE INVENTION

This invention resides in a tool for use when releasing the king pin from a fifth wheel coupling mechanism used for coupling a trailer to a tractor vehicle wherein the coupling mechanism includes a handle which must be moved from a lock position at which the king pin is captured by the coupling mechanism and a release position at which the king pin is released from the coupling mechanism.

The tool includes a pair of telescoping shafts, one shaft of which is mounted within the other shaft and is telescopically movable relative to the other shaft between extended and retracted positions as the one shaft is moved into and out of one end of the other shaft. The tool also includes a hook which is affixed to a telescoping end of one of the shafts for hooking the handle of the coupling mechanism. The shafts are cooperable with one another so that the one shaft is prevented from being totally removed from the other shaft and so that when the shafts are positioned in the retracted position, the hook is hooked about the handle of the coupling mechanism and the shaft to which the hook is not affixed is suddenly pulled away from the handle in a direction which corresponds generally with the direction in which the handle is moved when the handle is moved from its lock position to its release position and so that the tool telescopes to the extended position, the momentum of the pulled shaft is transferred to the coupling mechanism handle through the other shaft and hook so that the handle moves from its lock position to its release position.

The tool permits the handle of the coupling mechanism to be reached by the operator without any need that the operator's arms be positioned between the trailer and the tractor tires when releasing the king pin from the coupling mechanism. If the coupling mechanism includes a safety catch which prevents inadvertent movement of the handle from its lock position, the tool may be used to move the safety catch to an out-of-the-way condition before the tool is used to move the handle to its release position.

DETAILED DESCRIPTION OF AN ILLUSTRATIVE EMBODIMENT

Figure 1:
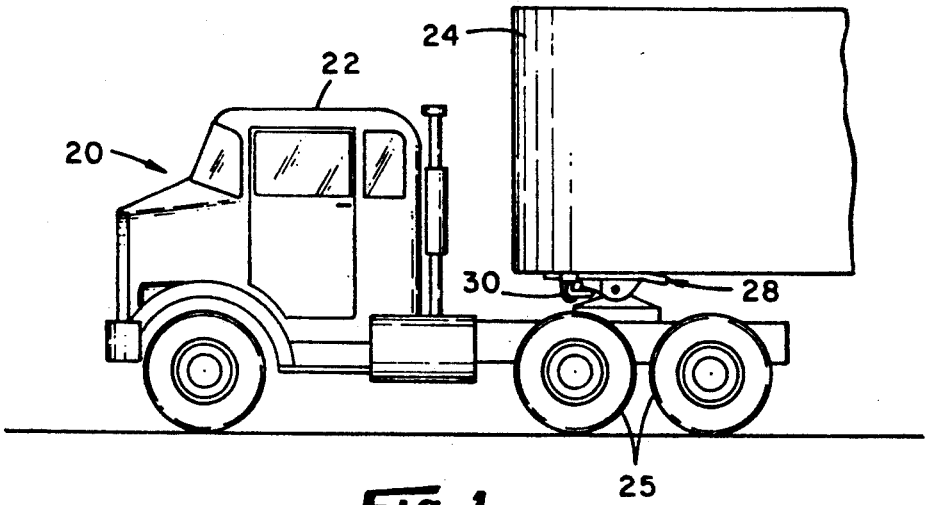
FIG. 1 is a fragmentary side elevational view of a tractor trailer rig embodying a king pin coupling mechanism of the class which may be released with the tool embodying features of the present invention.
Figure 3:
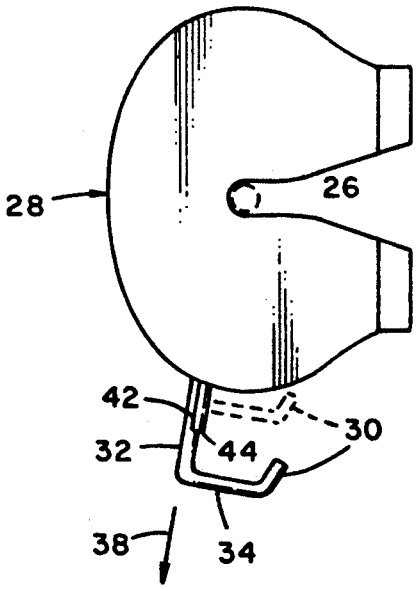
FIG. 3 is a schematic top plan view of the coupling mechanism of FIG. 2.

Turning now to the drawings in greater detail, there is shown in FIG. 1 a tractor-trailer rig 20 having an over-the-road tractor 22 and a trailer vehicle 24 which are coupled together by means of a king pin 26 (FIG. 3) and a fifth wheel coupling mechanism 28. The coupling mechanism 28 is associated with the tractor 22 and positioned adjacent the rear wheels 25 thereof and is conventional in construction so that a detailed description of its internal components is not believed to be necessary. Suffice it to say, however, that the coupling mechanism includes a handle 30 which must be moved between two positions of movement in order to release the king pin 26 from the mechanism 28. More specifically and with reference to FIG. 3, the handle 30 must be moved from a lock position, illustrated in phantom in FIG. 3, at which the king pin 26 is captured by the coupling mechanism 28 and a release position, illustrated in solid lines in FIG. 3, at which the king pin 26 is released from the coupling mechanism 28. The handle 30 has a shaft 32 and a grip 34 which extends at substantially a right angle to the shaft 32, and when moved between its lock and release positions, its shaft 32 is moved axially from a retracted position to an extended position and in the direction of the arrow 38. Heretofore, the movement of the handle 32 has been effected by grasping and pulling upon the grip 34 in the direction of the arrow 38.

Figure 2:
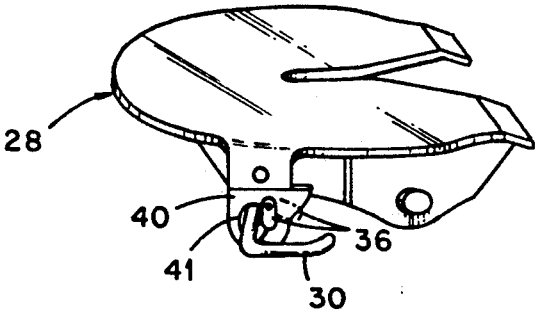
FIG. 2 is a schematic perspective view of the king pin coupling mechanism of the FIG. 1 rig.

As best shown in FIG. 2, the coupling mechanism 28 also includes a safety catch 36 which cooperates with the handle 30 to prevent the handle 30 from being unintentionally moved out of its lock position. The safety catch 36 is in the form of an elongated member which is supported by a guideway 40 having an opening 41 through which the handle shaft 32 extends. The catch 36 is pivotally joined to the guideway 40 at a location above the guideway opening 41 for movement between an operative position illustrated in solid lines in FIG. 2, and an out-of-the-way position, illustrated in phantom in FIG. 2. A secondary bar 42 is welded alongside the handle shaft 32 so that one end, indicated 44, of the bar 42 is positioned adjacent the guideway opening 41 when the handle 30 is in its lock position. When the handle 30 is in its lock position and the safety catch 36 is positioned in its operative position (or FIG. 2 solid-line position), the bar end 44 is blocked by the catch 36 from passing through the guideway opening 41 in the direction of the FIG. 3 arrow 38. Consequently, the handle shaft 32 is prevented from moving axially through the opening 41 when the safety catch 36 is positioned in its operative position. If, on the other hand, the catch 36 is pivoted to one side of the opening 41 to its out-of-the-way position (or FIG. 2 phantom-line position), the secondary bar 42, and thus the handle shaft 32, may be moved axially through the opening 41 unobstructed by the catch 36.

Figure 4:
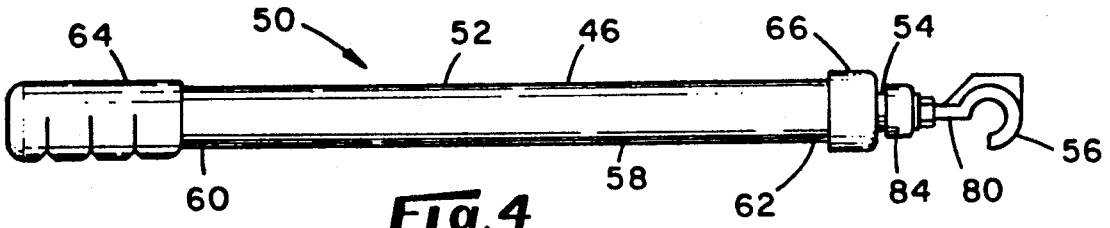
FIG. 4 is a side elevational view of an embodiment of a tool within which various features of the present invention are embodied and illustrating the tool when in a retracted condition.
Figure 5:
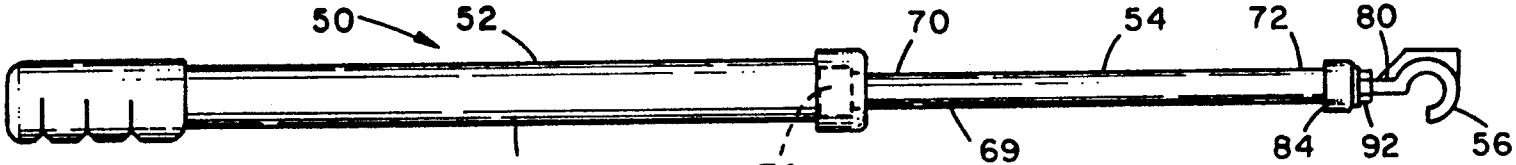
FIG. 5 is a view similar to that of FIG. 4 illustrating the tool when in an extended condition.
Figure 8:
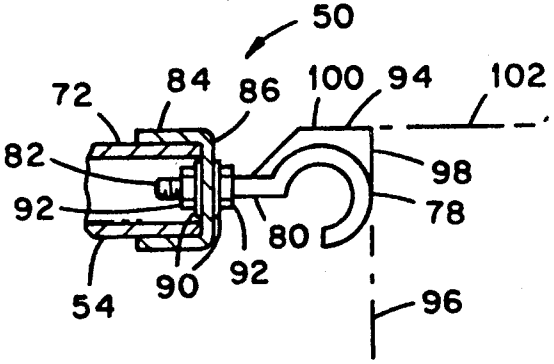
FIG. 8 is a longitudinal cross-sectional view of another fragment of the FIG. 4 tool.

With reference to FIGS. 4 and 5, there is illustrated a tool 50 embodying various features of the present invention and which can be used to move the safety catch 36 to its out-of-the-way position, and then uncouple the king pin 26 from the coupling mechanism 28 as the tool 50 is pulled abruptly with the hand.

The tool 50 includes a hollow main shaft 52, an inner secondary shaft 54 positioned within the main shaft 52 and a hook 56 attached to one end of the secondary shaft 54. The main shaft 52 includes a tube 46 having a cylindrical outer surface 58 and two opposite ends 60 and 62. Secured about one end 60 of the main shaft 52 is a hand grip 64 enabling the tool 50 to be comfortably grasped by the hand of a user. Secured about the other end of the main shaft 52 is a cup-shaped end cap 66 having an end wall 67 provided with an opening 68 (FIG. 7) positioned in registry with the longitudinal axis of the main shaft 52. In the depicted embodiment 50, each of the main shaft 52 and cap 66 are constructed of polyvinyl chloride (PVC) material and which are adhesively cemented together with a suitable adhesive, and the grip 64 is constructed of elastomeric material, such as rubber. It will be understood, however, that other materials may be used to construct the components of the tool 50.

Figure 7:
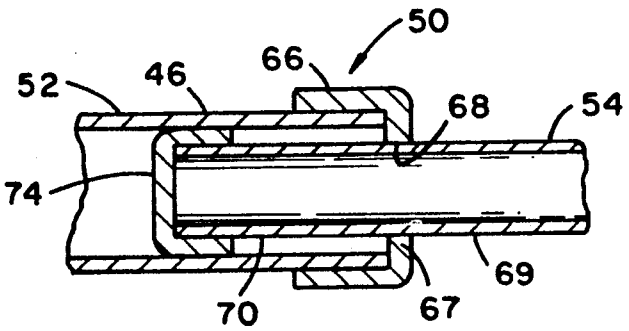
FIG. 7 is a longitudinal cross-sectional view of one fragment of the FIG. 4 tool.
Figure 6:
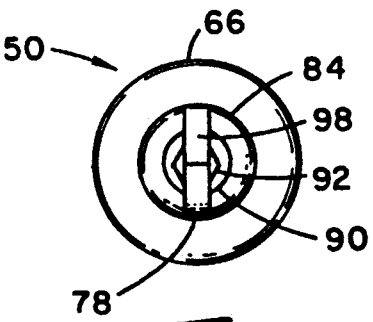
FIG. 6 is an end elevational view of the FIG. 4 tool as viewed from the right in FIG. 4.

The secondary shaft 54 includes a tube 69 having two ends 70 and 72 and an end cap 74 secured about the tube end 70. As best shown in FIG. 7, the diameter of the end cap 74 is less than the inside diameter of the tube 46 of the main shaft 52 and is larger than that of the opening 68 provided in the end cap 66. Accordingly, the secondary shaft 54 may be slidably moved along the length of the main shaft 52 in telescoping fashion between a retracted position as illustrated in FIG. 4 and an extended position as illustrated in FIG. 5. At the same time, however, the end cap 74 is captured within the main shaft 52 so as to prevent the total withdrawal of the secondary shaft 54 from the main shaft 52.

With reference to FIGS. 4–6 and 8, the hook 56 of the tool 50 is fixedly attached to the tube end 72 of the secondary shaft 54. The hook 56 includes a C-shaped portion 78 and a neck 80 having a threaded end portion 82. For attachment of the hook 56 to the tube end 72, the secondary shaft 54 includes a cup-shaped cap 84 including a flat wall 86 having a center hole through which the neck 80 of the hook 56 extends. A pair of steel washers 90 are positioned about the neck 80 and on opposite sides of the cap wall 86, and steel nuts 92 are threadably positioned about the neck 80 and on opposite sides of the washers 90. When the nuts 92 are tightened about the neck 80 and toward one another, the washers 90 and cap wall 86 are tightly held between the nuts 92 so that the hook 56 is securely attached to the cap 84. The cap 84 is, in turn, attached to the tube end 72 to secure the hook 56 to the shaft tube 69. In the illustrated embodiment 50, each of the cap 74, tube 69 and end cap 84 are constructed of a PVC material and cemented to one another with a suitable adhesive.

With reference again to FIGS. 6 and 8, the hook 56 includes a flange 94 extending along a major portion of the length of the C-shaped portion 78 and the neck 80. The flange 94 is slightly smaller in thickness than that of the C-shaped portion 78 and neck 80 and terminates at the leading end of the hook 56 in a surface 98 arranged in a plane 96 oriented substantially perpendicular to the longitudinal axis of the shaft tube 68 and terminates, to one side of the hook 56 in a surface 100 arranged in a plane 102 oriented substantially parallel to the longitudinal axis of the shaft tube 68. In the depicted tool 50, the hook 76 is formed of a suitable material, such as steel.

Figure 9:
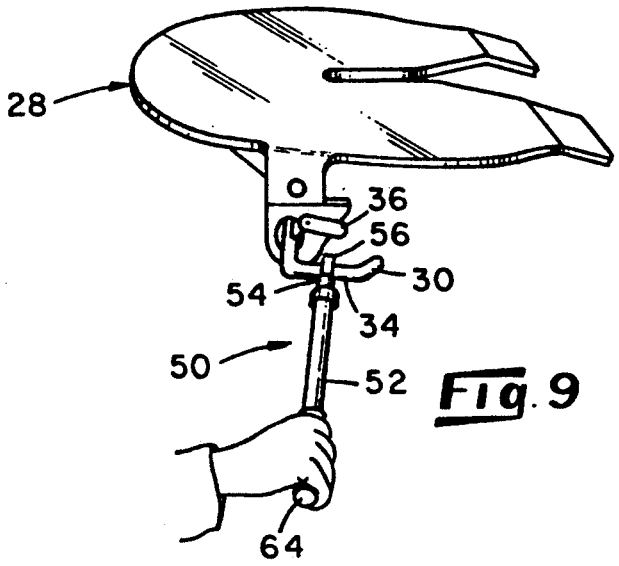
FIGS. 9 and 10 are views illustrating the use of the FIG. 4 tool when releasing the coupling mechanism of the FIG. 1 rig.
Figure 10:
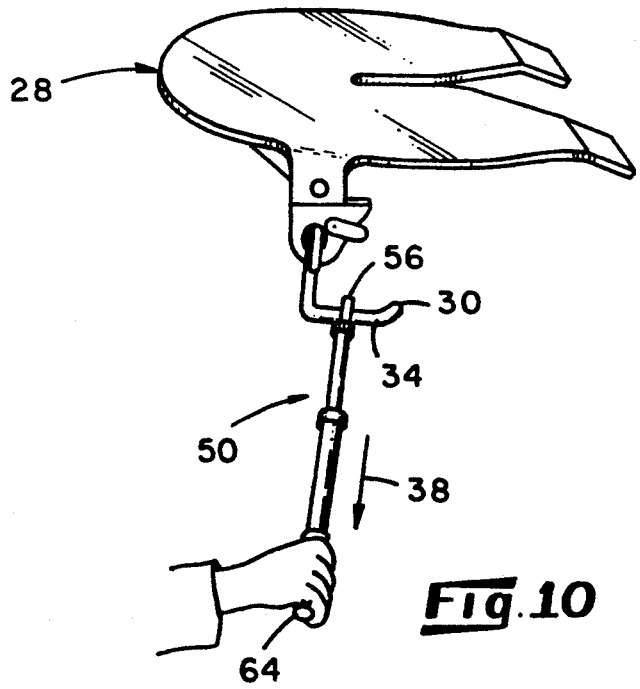

To use the tool 50 to move the safety catch to its out-of-the-way position and then uncouple the king pin 26 from the coupling mechanism 28, the secondary tube 54 is positioned in its FIG. 4 retracted position and the grip 64 of the main shaft 52 is grasped by the hand of an operator. The operator then reaches into the space provided between the trailer 24 and tractor tires 25 of the FIG. 1 rig 20 with the tool 50 and moves the safety catch 36 to its out-of-the-way position by pushing the catch 36 in the appropriate direction with the surface 100 of the hook flange 94. Such a movement of the safety catch 36 may be effected by knocking the catch 36 to its out-of-the-way position with the hook flange surface 100. The hook 56 is then hooked about the grip 34 of the handle 30 as shown in FIG. 9 so that the shafts 52 and 54 of the tool 50 are oriented along a path corresponding with the direction, i.e., of the FIG. 3 arrow 38, in which the handle 30 is moved when the handle 30 is moved from its lock position to its release position. The tool grip 64 is then suddenly pulled or jerked axially, as illustrated in FIG. 10, in the direction of the arrow 38 so that the main shaft 52 moves lengthwise relative to the inner shaft 54 to suddenly move the tool 50 to its extended condition. Upon movement of the tool 50 to its extended condition and with reference again to FIG. 7, the sides of the cap 74 strikingly abut the end wall 67 of the cap 66 to abruptly halt the lengthwise movement of the main shaft 52 relative to the inner shaft 54. Upon striking of the sides of the end cap 74 against the cap end wall 67, the momentum of the main shaft 52 is transferred to the handle 30 through the inner shaft 54 and hook 56 so that the handle 30 moves from its lock position to its release position.

It follows from the foregoing that the tool 50 provides an effective means for both moving the safety catch 36 to an out-of-the-way position and pulling the handle 30 to its release position. At the same time, the tool 50 circumvents any need that the arms of the operator be positioned within the cramped space provided between the trailer 24 and tractor tires 25 where the arms may be exposed to an unnecessary danger. By way of example, a tool 50 possessing a retracted length of about 28.0 inches and an extended length of about 36.5 inches has been found to be well-suited for its intended purpose.

It will be understood that numerous modifications and substitutions may be had to the aforedescribed embodiment 50 without departing from the spirit of the invention. Accordingly, the aforedescribed embodiment 50 is intended for the purpose of illustration and not as limitation.

What is claimed is:

1. A tool for use when releasing the king pin from a fifth wheel coupling mechanism used for coupling a trailer to a tractor vehicle wherein the coupling mechanism includes a handle which must be moved from a lock position at which the king pin is captured by the coupling mechanism and a release position at which the king pin is released from the coupling mechanism and further includes a safety catch which must be moved to an out-of-the-way condition before the handle can be moved from its lock position to its release position, said tool comprising:

a pair of telescoping shafts, one shaft of which is mounted within the other shaft and which is telescopically movable relative to the other shaft between extended and retracted positions as the one shaft moves into and out of one end of the other shaft, the distance through which the one shaft is capable of moving relative to the other shaft between extended and retracted positions being at least 8.5 inches; and a hook affixed to a telescoping end of one of the shafts for hooking the handle of the coupling mechanism;

said shafts being cooperable with one another so that said one shaft is prevented from being totally removed from the other shaft and so that when the shafts are positioned in the retracted position, the hook is hooked about the handle of the coupling mechanism, and the shaft to which the hook is not affixed is suddenly pulled away from the handle in a direction which corresponds generally with the direction in which the handle is moved when the handle is moved from its lock position to its release position and so that the tool suddenly telescopes to the extended position and the pulled shaft thereby moves through a distance which is at least as great as 8.5 inches, the momentum of the pulled shaft is transferred to the coupling mechanism handle through the hook so that the handle moves from its lock position to its release position; and the shafts include cooperating means providing abutment surfaces for abutting one another over a relatively large area so that the momentum transferred from the pulled shaft to the coupling mechanism handle through the shaft to which the hook is attached is distributed over the relatively large area of the abutment surfaces; and said hook has a C-shaped body portion opening generally in one direction and a flange portion attached to the C-shaped portion which defines a surface oriented to one side of the longitudinal axis of the shaft to which the hook is affixed and disposed to one side of the C-shaped portion opposite said one direction for moving the safety catch to its out-of-the-way condition when the safety catch is struck with said surface of said flange portion and so that movement of the safety catch to its out-of-the-way condition with the flange portion surface positions the C-shaped body portion in condition for hooking the coupling mechanism handle.

2. The tool as defined in claim 1 wherein said one end of said other shaft has an opening through which said one shaft extends, and said one end of said one shaft which is mounted within the other shaft has an enlarged portion which is sized to prevent passage of said one end of said one shaft through the opening provided in the one end of said other shaft so that the enlarged portion is captured within said other shaft.

3. The tool as defined in claim 2 wherein said other shaft includes means defining an abutment wall adjacent the one end of said other shaft and said opening is provided in said abutment wall, and the abutment wall and enlarged portion provide the abutment surfaces through which the momentum of the pulled shaft is transferred to the hook when the tool is suddenly telescoped to the extended position.

4. A tool for use when releasing the king pin from a fifth wheel coupling mechanism used for coupling a trailer to a tractor vehicle wherein the coupling mechanism includes a handle which must be moved in a linear direction from one position of movement corresponding to a lock position and another position of movement corresponding to a release position in order to release the king pin and includes a safety catch which must be moved to an out-of-way condition before the handle can be moved from its lock position to its release position, said tool comprising:

a hollow main shaft having an opening provided in one end thereof;

a secondary shaft mounted within the main shaft for telescopic movement into and out of the opening provided in said main shaft between extended and retracted positions, the distance through which the secondary shaft and main shaft are capable of moving in one direction relative to one another during telescopic movement being at least as great as 8.5 inches, said secondary shaft having a free end which extends out of the opening provided in said main shaft and an opposite end which is captured within the main shaft so that the secondary shaft is prevented from being totally removed from the main shaft; and a hook affixed to the free end of the secondary shaft and adapted to hook the handle of the coupling mechanism;

said one end of the main shaft being cooperable with the opposite end of the secondary shaft so that when the secondary shaft is positioned within the main shaft in its retracted position, the hook is hooked about the handle of the coupling mechanism, the tool is arranged so that the secondary shaft extends from the handle in a direction which corresponds generally with the direction in which the handle is moved when the handle is moved from its lock position to its release position and the main shaft is suddenly pulled away from the handle so that the secondary shaft suddenly telescopes to its extended position and thereby moves through a distance which is at least as great as 8.5 inches, the momentum of the main shaft is transferred to the coupling mechanism handle through the hook so that the handle moves from its lock position to its release position; and the secondary shaft and the main shaft include means providing abutment surfaces for abutting one another over a relatively large area so that the momentum transferred from the main shaft to the coupling mechanism handle through the secondary shaft is distributed over the relatively large area of the abutment surfaces; and said hook has a C-shaped body portion opening generally in one direction and a flange portion attached to the C-shaped portion which defines a surface oriented to one side of the longitudinal axis of the secondary shaft and disposed to one side of the C-shaped portion opposite said one direction for moving the safety catch to its out-of-the-way condition when the safety catch is struck with said surface of said flange portion and so that movement of the safety catch to its out-of-the-way condition with the flange portion surface positions the C-shaped body portion in condition for hooking the coupling mechanism handle.

5. The tool as defined in claim 4 wherein the secondary shaft has an enlarged portion positioned adjacent said opposite end which is sized to prevent passage of said opposite end through the opening so that the enlarged portion is captured within the main shaft.

6. The tool as defined in claim 5 wherein the main shaft includes means defining an abutment wall adjacent said one end of said main shaft and the opening in said one end of the main shaft is provided in the abutment wall, and the abutment wall and enlarged portion provide the abutment surfaces through which the momentum of the main shaft is transferred to the secondary shaft when the tool is suddenly telescoped to its extended position.

7. The tool as defined in claim 6 wherein the abutment wall provides one abutment surface of the abutment surfaces, and the one abutment surface is oriented generally perpendicular to the longitudinal axis of the main shaft and the enlarged portion provides another abutment surface of the abutment surfaces, and the another abutment surface is oriented generally perpendicular to the longitudinal axis of the secondary shaft so that when the secondary shaft is suddenly telescoped to its extended position, the enlarged portion strikes the abutment wall along a plane oriented generally perpendicular to the longitudinal axis of the main shaft to transfer the momentum of the main shaft to the secondary shaft.

8. The tool as defined in claim 7 wherein the main shaft includes a tube and a cap affixed to one end of the tube, said cap having a hole extending therethrough which provides the opening in said one end of the main shaft.

9. The tool as defined in claim 7 wherein the secondary shaft includes a tube having a first end which is captured within the main shaft and a cap affixed to said first end and having sides which encircle the secondary tube at said first end, and the enlarged portion is provided by said cap.

10. The tool as defined in claim 4 wherein each of the main shaft and secondary shaft includes a tube of polyvinyl chloride material.

11. The tool as defined in claim 4 wherein the main shaft includes a grip portion adjacent the end of the main shaft opposite said one end enabling the main shaft to be gripped by the hand for use.

12. In combination with a fifth wheel coupling mechanism used for coupling a trailer to a tractor vehicle by means of a king pin, said coupling mechanism including a handle which must be moved from one position of movement corresponding to a lock position and another position corresponding to a release position, a tool for releasing the king pin including (a) a pair of telescoping shafts, one shaft of which is mounted within the other shaft and which is telescopically movable relative to the other shaft between extended and retracted positions as the one shaft moves into and out of one end of the other shaft, the distance through which the one shaft is capable of moving relative to the other shaft between extended and retracted positions being at least as great as 8.5 inches; and (b) a hook attached to a telescoping end of one of the shafts so that the hook is secured in a fixed position relative to said one shaft for hooking the handle of the coupling mechanism;

(c) the telescoping shafts having a retracted length of at least about 28.0 inches so that when the telescoping shafts are in the retracted position, the handle of the coupling mechanism can be reached with the hook over an appreciable distance, and said shafts being cooperable with one another so that said one shaft is prevented from being totally removed from the other shaft and so that when the shafts are positioned in the retracted position, the hook is hooked about the handle of the coupling mechanism, and the shaft to which the hook is not affixed is suddenly pulled away from the handle in a direction which corresponds generally with the direction in which the handle is moved when the handle is moved from its lock position to its release position so that said one shaft is exposed to an impulse from the pulled shaft after said pulled shaft moves through a distance which is at least as great as 8.5 inches, the impulse to which said one shaft is exposed acts upon the coupling mechanism handle through the hook so that the handle moves from its lock position to its release position.

13. The combination as defined in claim 12 wherein said one end of said other shaft has an opening through which said one shaft extends, said one end of said one shaft which is mounted within the other shaft has an enlarged portion which is sized to prevent passage of said one end of said one shaft through the opening provided in the one end of said other shaft so that the enlarged portion is captured within said other shaft.

14. The combination as defined in claim 13 wherein said other shaft includes means defining an abutment wall adjacent said one end of said other shaft and said opening is provided in said abutment wall, and the abutment wall and enlarged portion provide the abutment surfaces through which the momentum of the pulled shaft is transferred to the hook when the tool is suddenly telescoped to its extended position.

15. The combination as defined in claim 14 wherein the abutment wall of said other shaft provides one abutment surface of the abutment surfaces, and the one abutment surface is oriented generally perpendicular to the longitudinal axis of said other shaft and the enlarged portion of said one shaft provides another abutment surface of the abutment surfaces, and the another abutment surface is oriented generally perpendicular to the longitudinal axis of said one shaft so that when the tool is suddenly telescoped to its extended position, the enlarged portion strikes the abutment wall along a plane oriented generally perpendicular to the longitudinal axis of said other shaft to transfer the momentum of the pulled shaft to the hook.

16. The combination as defined in claim 15 wherein said other shaft includes a tube and a cap affixed to one end of the tube, said cap having a hole extending therethrough which provides the opening in said one end of said other shaft.

17. The combination as defined in claim 15 wherein said one shaft includes a tube having a first end which is captured within said other shaft and a cap affixed to said first end and having sides which encircle the tube of said one shaft at said first end, and the enlarged portion is provided by said cap.

18. The combination as defined in claim 12 wherein the coupling mechanism includes a safety catch which must be moved from an operative position to an out-of-the-way position before the handle can be moved from its locked position to its release position, and said hook has a C-shaped body portion opening generally in one direction and a flange portion attached to the C-shaped portion which defines a surface oriented to one side of the longitudinal axis of said one shaft and disposed to one side of the C-shaped portion opposite said one direction for moving the safety catch to its out-of-the-way position when the safety catch is struck with said surface of said flange portion and so that upon movement of the safety catch to its out-of-the-way condition with the flange portion surface positions the C-shaped body portion in condition for hooking the coupling mechanism handle.

19. The combination as defined in claim 12 wherein each of said one shaft and said other shaft includes a tube of polyvinyl chloride material.

20. The combination as defined in claim 12 wherein the pulled shaft includes a grip portion adjacent one of its ends enabling the pulled shaft to be gripped by the hand for use.

* * * * *